US006727470B2

(12) United States Patent
Reichle

(10) Patent No.: US 6,727,470 B2
(45) Date of Patent: Apr. 27, 2004

(54) IMPEDANCE HEATING FOR RAILROAD TRACK SWITCH

(75) Inventor: David L. Reichle, Littleton, CO (US)

(73) Assignee: Fastrax Industries, Inc., Littleton, CO (US)

( * ) Notice: Subject to any disclaimer, the term of this patent is extended or adjusted under 35 U.S.C. 154(b) by 0 days.

(21) Appl. No.: 10/071,567

(22) Filed: Feb. 7, 2002

(65) Prior Publication Data

US 2003/0146207 A1 Aug. 7, 2003

(51) Int. Cl.[7] ..... H05B 3/06; H05B 6/10

(52) U.S. Cl. ..... 219/213; 219/635; 219/639; 219/537; 104/279; 246/428

(58) Field of Search ..... 219/635, 639, 219/672, 676, 213, 536, 537; 104/279, 280; 246/428

(56) References Cited

U.S. PATENT DOCUMENTS 5,004,190 A * 4/1991 Montierth et al. ..... 246/428
5,348,257 A * 9/1994 Ocampo ..... 246/428
5,389,766 A * 2/1995 Takahashi et al. ..... 219/635

FOREIGN PATENT DOCUMENTS

JP 7-216842 * 8/1995

* cited by examiner

*Primary Examiner*—Philip H. Leung
(74) *Attorney, Agent, or Firm*—Marsh Fischmann & Breyfogle LLP

(57) ABSTRACT

A heating system for railroad switches or other movable railroad structures that substantially eliminates protruding heater elements that may be damaged. The heater elements may cast into, enclosed within or received within recesses of a tie (including a metal or concrete tie), rail or other component. In one implementation, inductive heating is used to directly heat the rail, tie or other structure.

19 Claims, 8 Drawing Sheets

IMPEDANCE HEATING FOR RAILROAD TRACK SWITCH

FIELD OF THE INVENTION

The present invention relates in general to railroad track switch heaters and, in particular, to impedance based and other heating systems that provide the desired heating for switches and other railroad components with reduced heating structure that can become damaged or pose hazards in the vicinity of a switch.

BACKGROUND OF THE INVENTION

Railroad track switches typically involve a pair of stationary rails and a pair of switching rails that move between engaged and disengaged positions. In the engaged position, commonly referred to as the "reverse position," a switching rail abuts the gauge side of a stationary rail, i.e., the side which engages the flange of a train wheel, so as to divert the train wheel from the stationary rail and the corresponding track to another track. In the disengaged position, commonly known as the "normal position," the switching rail is separated from the gauge side of the stationary rail so that a passing wheel is unaffected by the switching rail.

In order to ensure proper functioning of a railroad switch, it is important that the switching rail and stationary rail make good contact in the engaged position. Accordingly, in cold climates, it is common to heat the rail switch or otherwise guard against build up of ice or snow at the switch, especially at the interface between the gauge side of the stationary rail and opposite side of the switching rail.

It will be appreciated that a malfunctioning switch presents a danger of derailment resulting in severe personal and property damage. Although switches are now normally equipped with sensors to provide advance warning in the event of a potentially malfunctioning switch, switch contact problems are nonetheless a hazard, can result in considerable delay and annoyance, and are a significant burden to the rail transportation system in cold climates. Switch malfunctions also result in loss of track time for cargo and other commerce, thereby adversely affecting profitability.

A number of different types of track switch heaters have been devised including heaters that operate on radiant (e.g., infrared element), convective (e.g., forced air); and/or conductive (e.g., electrical heater element) principles. Among these, certain heaters have relative advantages for particular applications based on efficiency, availability of an appropriate power source at a remote location or other considerations.

However, known track switch heaters are subject to one or more of the following disadvantages. First, some heaters can be damaged or can become worn due to repeated movement of the tracks incident to switching. In addition, some heaters are inefficient due to their reliance on convective or radiant heating. Other heaters are inefficient due to use of a small surface area for conductive heat transfer or uneven heat distribution across the heat transfer surface. In this regard, rounded heater element housings have a limited area of direct thermal contact and, in operation, such contact may be further limited if the housing becomes disfigured due to thermal warping or impact.

SUMMARY OF THE INVENTION

The present invention is directed to various implementations of a railroad track switch heating system that reduce or eliminate the need for heater elements or other heater components protruding from rail surfaces in the area of the switch. It has been recognized that such protruding elements are a common source of failures or malfunctions of heating systems. In particular, as noted above, the track switch environment is a rugged environment where protruding elements may be damaged by operation of the switch. In addition, such elements may be damaged during servicing of the track. For example, the track bed may be serviced periodically by machinery that grips and lifts the track or ties so that the bedding material can be restored. Such equipment can damage protruding elements. Moreover, the track itself may occasionally be manipulated by servicemen installing or repairing components related to track signaling and the like. Again, protruding elements are subject to inadvertent damage during such servicing. Protruding elements may also become warped, bent, or otherwise fail to maintain good thermal contact with the track, resulting in heating inefficiencies. In this regard, track surfaces may include raised lettering and other topological features that can interfere with good thermal contact between a rail and an external heating element. Such problems are reduced or eliminated by the present invention.

In accordance with the present invention, a heating system for heating a section of railroad track is disclosed. The heating system includes a power source for providing electrical power, a first heater assembly associated with a railroad structure located in the section of railroad track that is to be heated, wherein the heater assembly has at least a first heater structure which does not substantially protrude above the surface of the railroad structure; an electrical interface for applying an electrical potential across the heater structure in order to produce a current within the structure and control means to control the heat applied to the section of railroad track. Depending on the application, the power source may be, for example, a line of a power grid, where available, or a generator system, regardless of the source, the electrical power may be provided via either alternating current (AC) or direct current (DC) for use in the heating system. The control may include a processor for controllably delivering electricity to the electrical interface (e.g., via electrical leads) and a transformer to provide an electric signal suitable for heating the track without creating undue hazards for workmen or others. The controller may be associated with a thermal sensor to provide feedback regarding the temperature of the track. Feedback may also be provided regarding ambient conditions so as to provide an indication of potential ice buildup in the vicinity of the switch.

In a first aspect of the present invention the system's heater assembly has a heater structure at least partially embedded within a railroad structure located in the section of the railroad track to be heated. In this regard, the heater structure may comprise some sort of separate heating element that is embedded within a railroad structure located in the section of railroad to be heated. Again, this embedded heating element will be substantially non-protruding above the surface of the railroad structure in which it is embedded.

Various refinements exist to the elements included in the first aspect of the present invention. For example, in one embodiment of the first aspect of the present invention, the heater structure is embedded in a railroad tie for placement beneath and interconnection with the track rails of the railroad section to be heated. The embedded heater structure is used to provide thermal energy to the track rails and the general area surrounding the track rails to clear snow and ice while not substantially protruding above the surface of the railroad tie. In many cases, concrete, metal or other prefabricated railroad ties are being used in place of traditional ties formed from timbers. The construction process for such ties (as well as conventional timber ties) can readily be adapted so that a heater structure may be embedded in a surface of these ties (e.g., an upper surface of the tie adjacent to the rail track attachment locations). Such heater structures may extend across the width of the tie or be exposed only in the area of the track rail. Preferably, the heater structure is embedded so that it is substantially flush with an upper surface of the tie. In this regard, one surface of the heater structure may be exposed on the tie's surface such that the heater is disposed between the tie and the track rail upon assembly to increase heat transfer therebetween.

In another embodiment of the first aspect of the present invention, the heater assembly is embedded or interconnected with the track rail such that the heater structure does not substantially protrude above the surface of that track rail. In this regard, a recess may be formed on a surface or a void created within the cross-section of the rail structure that substantially conforms to the dimensions of a heater structure (e.g., a resistive heating element). As will be appreciated, utilizing a recess or void in the track rail surface provides for increased surface area contact between the track rail and a heating structure (e.g., three sides of a rectangular heating element) in addition to protecting the heater structure from the harsh railroad environment. This recess may be formed on the track rail's web or, more preferably, on the track rail's bottom surface such that the heater structure is further isolated from the rail environment, thus providing a system having increased reliability. Where the rail section is formed with an internal cavity for receiving the heater structure, it will be appreciated that there is substantially no convective and/or radiative heat transfer losses from the heater element to the atmosphere, thus providing a highly efficient track rail heating system.

In either of the above embodiments of the first aspect of the present invention, the embedded heater structure may comprise a resistive type heater element that may comprise one or more separate pieces. For example, the heater structure may comprise a sleeve member embedded with the railroad structure (i.e., tie, track rail, etc.) and an electric resistive heater element slidably receivable within the sleeve member. Preferably, the sleeve is attached to the railroad structure such that the slidably receivable heater element may be readily inserted and removed from the sleeve member, thus, providing for a heating system that is easily maintainable. Alternatively, this sleeve may be directly heated using an impedance heating system as discussed below. Additionally, a cartridge heater such as a split sheath cartridge heater. may be inserted into the sleeve. For example, the split sheath cartridge heater may include two generally semi-circular heater elements (or one element folded back over itself) sized to be received in the sleeve. Upon heating, the elements expand to force good thermal contact with the sleeve, thus promoting efficient heat transfer.

In another variation of the heater structure for use with the embodiments of the first aspect of the present invention, an impedance type heater unit is utilized. Generally, the impedance type heater unit includes at least a first conductive metallic element for producing heat. Further, in the impedance heater unit the heater system's electrical interface is provided by way of a first electrical lead connected to a first point on the metallic element and a second electrical lead interconnected to a second point on the metallic element during operation of the heating system. These leads interface with the power source such that an electric current passes through the metallic element. One of the electrical leads is preferably disposed in an adjacent relationship with the metallic element along a conductive path between the first and second connection points to produce a magnetic flux within the metallic element such that the metallic element may itself function as a resistive type heating element.

The metallic element utilized with the impedance heating unit may generally incorporate any shape, so long as the metallic element is electrically conductive and has magnetic properties (e.g., steel, iron, or other ferromagnetic materials). For example, the metallic element may be similar to the sleeve member discussed above wherein each end of a ferromagnetic sleeve member is interconnected to the power source such that an electrical current travels through the sleeve and at least one lead is disposed adjacently to the sleeve's surface between the first and second ends. Alternatively, the metallic element may be a metallic plate embedded within a concrete or other prefabricated railroad tie. Regardless of what metallic element is used, it is preferable that the electrical leads used to interconnect the metallic element to the power source are disposed beneath the element such that they are further isolated from the track environment (i.e., non-protruding).

In a second aspect of the present invention the system's heater assembly has a heater structure that is integrally formed within a railroad structure located in the section of railroad to be heated. In this regard, the heater structure may utilize part of the railroad structure in the section of railroad to be heated to generate the heat required to keep that railway section free from snow and ice. Accordingly, where the heater structure is integrally formed within the railway structure there are substantially no heater elements protruding above the surface of the rail structure.

Various refinements exist of the elements noted in relation to the second aspect of the present invention. Further features may also be incorporated in the second aspect of the present invention as well. These refinements and features may exist individually or in any combination. In one embodiment of the second aspect of the present invention the heater structure is integrally formed within a metallic tie. In this regard, the metallic tie itself is utilized as an impedance heating system's metallic element such that the heater structure is integrally formed as part of the railroad structure (e.g., a sidewall of the tie). Utilizing the metallic tie, an electrical current may be passed through a portion of the metallic tie such that an impedance heating circuit is created. As will be appreciated, this provides for a heater element (the tie itself) that may have a substantial thickness such that it is resistant to damage and is substantially immune from burnout as is common with some resistive type heater elements. The tie also provide increased heat transfer to the area to be heated (i.e., track rails and the area therebetween) since the heat is generated within the metallic tie's wall there are no heat transfer losses as are typical with bolt on type electric heater elements. Additionally, metallic ties are generally hollow which provides an inside surface for interconnecting all the heating system's components such that none of these components protrude into the track rail environment. In this regard, a heater may be conveniently bolted within the tie. Such a heater may also be utilized to effectively heat switch systems that incorporate certain elements, such as tie rods and the like, within the interior space of the hollow tie. It will be appreciated that such switching systems include other elements that are exposed to the external environment and may therefore benefit from heating. These systems can be effectively heated by the various heater embodiments described herein.

In another embodiment of the second aspect of the present invention, a heating system utilizes a heater structure integrally formed in the rail track itself for heating a section of railroad track. In this regard, the rail track is utilized as the metallic element for an impedance heating unit. A first electrical lead interconnects a first section of the rail track and a second electrical lead interconnects a second portion on the rail track such that an electrical current may flow through the rail. Preferably the rail track will include a recess in which one of the electrical leads may be disposed adjacent to the rail track such that that lead does not protrude above the rail surface. This recess may be located on the bottom of the rail track to provide an additional degree of protection for the electrical lead. In addition, both leads may interconnect the track rail on the bottom surface such that the impedance heating system has no elements protruding from into the rail track environment. As will be appreciated, this embodiment of the present invention provides a system where the heat is directly generated within and by the rail track. In this regard, there are no conductive or radiative heat transfer losses in providing heat to the track rail. Accordingly, the efficiency of the rail track heater is improved allowing for a section of a railway to be effectively heated using less power than is required with bolt on or contact heater element systems.

A further feature related to any embodiment of the first and second aspects of the present invention deals with avoiding signaling interference that may be caused by the electrical energy of the heating system. This is especially pertinent in the second aspect of the present invention where the track rail is utilized as an impedance heating element that carries an electrical current for heating purposes. As will be appreciated, it is common for railroad tracks to carry various communication signals to and from trains traveling thereon. These signals may include, among others, switching commands and direct communications between a train and a control center. By applying an electrical current through the rail or creating an electromagnetic field of sufficient strength near the rail, the communication signals carried by the railroad tracks may experience interference. In this regard, it is desirable to provide means for preventing the heating system from unduly interfering with the communication signals. Various alternatives exist to accomplish this task. For example, the communication signals may continue to use the track rail as a communication medium so long as the heating energy (i.e., current) or electromagnetic field is sufficiently different from the communication signals so as to be easily distinguishable. This may be accomplished using sufficiently different frequencies for the communication signals and heating currents and/or filtering means such that any undesirable signals may be distinguished/filtered out of the communication signals. Alternatively, some sort of parallel path may be used to route the communication signals around the section of the track being heated. That is, the communication signals may avoid any interference that may be caused by the heating system by being routed around the heating system. Further, signals may utilize some other transmission medium. For example, the voice communication signals may be transmitted over the air and switching signals may utilize optical sensors, eddy current sensors and/or pressure transducers to detect the presence of a train. Accordingly these optical sensors and/or transducers may be hardwired to the track switch control, thereby eliminating the need for in track communications, etc. Regardless what means is utilized, what is important is that the communication signals are not unduly affected by the heating system.

BRIEF DESCRIPTION OF THE DRAWINGS

For a more complete understanding of the present invention and further advantages thereof, reference is now made to the following detailed description taken in conjunction with the drawings in which.

DETAILED DESCRIPTION

The following discussion relates to railroad track switch heating systems with minimal or substantially no heating elements protruding from the track rails or into the track rail environment. Such embodiments of the invention thereby reduce the likelihood of damage to or malfunctioning of the heating systems. Various implementations of such embedded or integrated heating systems are disclosed in the description that follows. Upon consideration of the following description, other implementations will occur to those skilled in the art. It should be explicitly understood that such alternative implementations are within the spirit and scope of the present invention.

Figure 1:
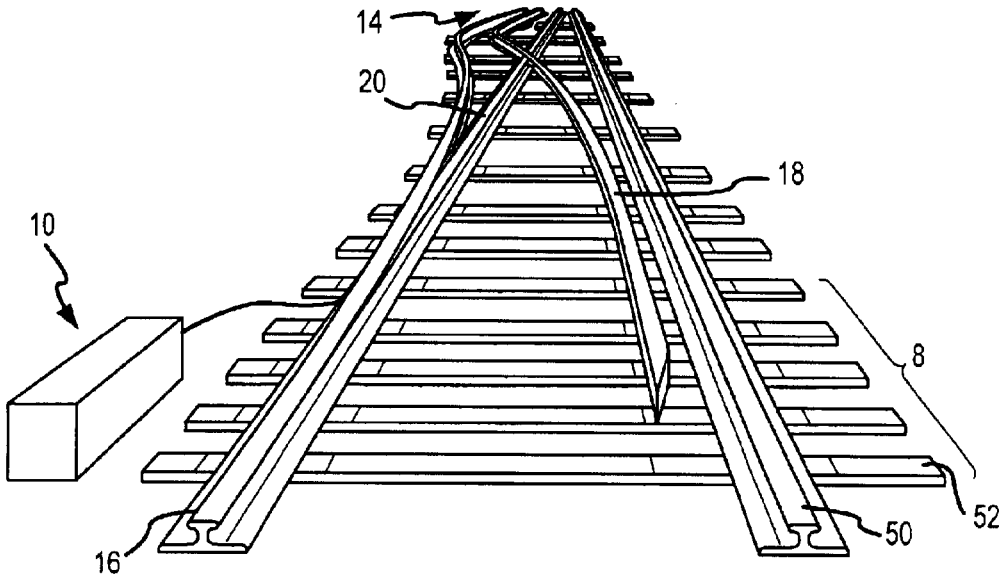
FIG. 1 is a perspective view showing a railroad track switch and associated heating system in accordance with the present invention.

Referring to FIG. 1, a railroad track switch is generally identified by the reference numeral 10. The track switch 10 is used, for example to switch train traffic between first 12 and second 14 tracks, both of which are supported on ties 52. Generally, the switch 10 includes a pair of fixed rails 16 and 22 and a pair of switching rails 18 and 20.

Although other implementations are possible, the illustrated switching rails 18 and 20 are positioned on the gauge (inner) side of each of the fixed rails 16 and 22 and are movable between reverse and normal positions. In FIG. 1, the first switching rail 18 is disengaged from the first fixed rail 22 and the second switching rail 20 is engaged to the second fixed rail 16. In this configuration, the switch 10 is set to select the first track 12. To select the second track 14, the switching rails 18 and 20 can be shifted in unison to the right, as viewed in FIG. 1, so that the first switching rail 18 abuts the first fixed rail 22 and the second switching rail 20 is disengaged from the second fixed rail 16.

It will be appreciated that proper operation requires good contact between the fixed rail 22 and switching rail 18 in the reverse position and between the fixed rail 16 and switching rail 20 in the normal position. The heater of the present invention enhances switch operation by reducing or substantially eliminating build up of ice or snow at the switch interface.

Figure 2:
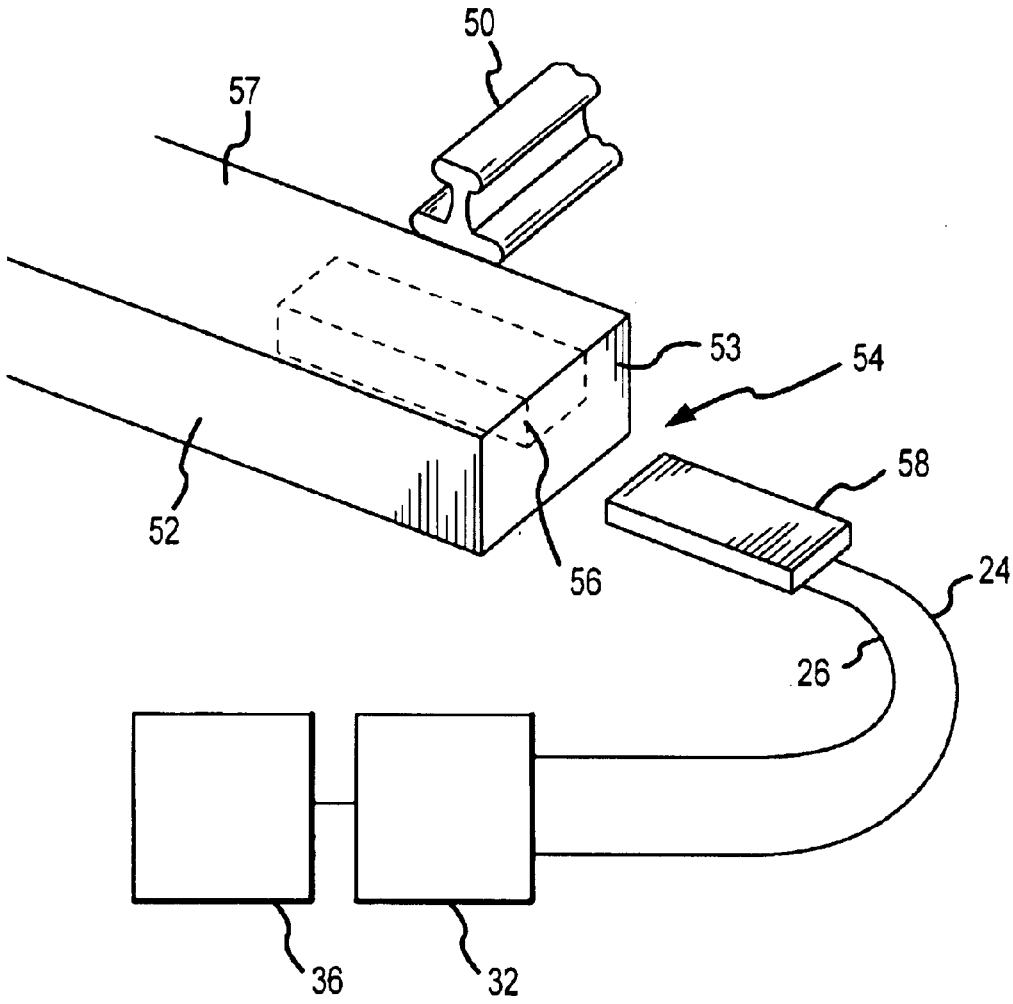
FIG. 2 is a perspective view showing a railroad tie with an embedded sleeve for slidably receiving a heater element in accordance with the present invention.

FIG. 2 illustrates an embodiment of the present invention utilizing a heating assembly 54 embedded in a structure associated with the railway section 8 to be heated. The heating assembly 54 may be embedded in a tie, a dedicated structural element, or other element, preferably disposed beneath the railway section 8 (See FIG. 1) to be heated. It will be appreciated that the railway section to be heated may include some or all of the length of the switch interface, and areas between the rails such as the track bedding or ballast which may be heated, for example, to prevent snow or ice build up on tie rods or other switch elements. In this case, the heater assembly 54 is embedded within a tie 52 underlying the rail 50. The system may be implemented in connection with prefabricated concrete or other ties 52 (e.g., wood, steel, etc.). In such cases, the heater assembly 54 is preferably embedded within an upper surface of the tie 52 such that there is little or no protrusion of the heater assembly 54 from the tie 52. The assembly 54 may extend across the width of the tie 52 or may be contained within a smaller area underlying the rail 50 as shown. In addition to being embedded within the tie 52, the leads 24, 26 to the heater assembly 54 may extend through an end surface 53 or bottom surface of tie 52 and, from there, lead to the appropriate electrical power source 36 and/or transformer 32. In this regard, the electrical leads 24, 26 are removed from the switching area and away from the rail 50, thus reducing the likelihood of damage to the electrical leads 24, 26 during operation/maintenance of the railway.

As shown in FIG. 2, a preferred embodiment of the embedded heater assembly 54 utilizes a sleeve member 56 embedded within the tie 52 wherein the sleeve 56 is designed to slidably receive an electrical heater element 58. The sleeve 56 may have any cross sectional shape designed to receive heater element 58 so long as the sleeve 56 and heater element 58 are substantially conformal, thus providing increased heat transfer therebetween. The heater element 58 may have a construction substantially as disclosed within U.S. Pat. No. 6,104,010. The sleeve 56 is embedded in the tie 52 such that there is little or no protrusion above the tie's top surface 57 and such that the sleeve 56 is near to or forms part of the tie's top surface 57, thus increasing heat transfer to the railway section 8 to be heated. The sleeve 56 may extend all the way through the tie 52 or alternatively two sleeves may be used (i.e., one on each end of the tie 52, not shown) to position separate heater elements 58 beneath the rails 50 mounted on the tie 52. In either embodiment, one end of the sleeve(s) 56 is accessible through the end surface 53 of the tie 52. In this regard, the heater element(s) 58 are accessible and easily replaced once their useful life is over. In addition, it will be appreciated that this embodiment fully protects the heater element 58 from the harsh railroad environment. If the sleeve 56 is a metallic member, it may also be used as a heater element in an impedance heating system (as will be more fully discussed herein). This is done by connecting the first lead 24 to the sleeve's open end and routing the second lead 26 through the inside of the sleeve 56 and connecting it to the sleeve's other end. As will be appreciated, the railway section 8 to be heated (e.g., switch section) may cover considerable distance of the track bed, in this regard numerous heated ties 52 may be placed beneath the rails 12 such that the entire area may be kept free of ice and snow.

Figure 8:
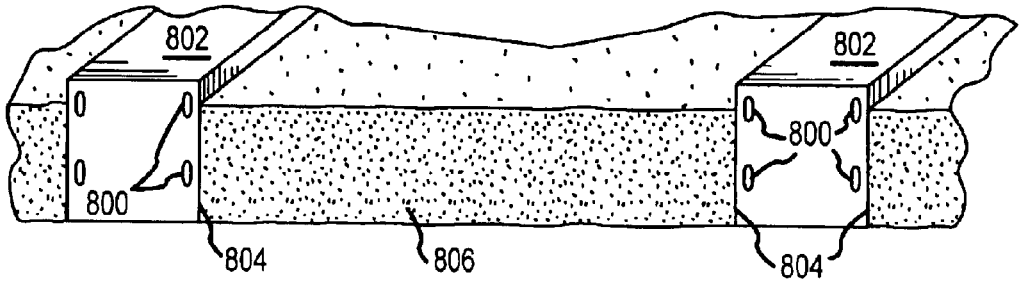
FIG. 8 is a perspective view showing a possible placement of heater elements to promote heating of the track bedding or ballast.

FIG. 8 shows an alternate placement of heater elements 800 relative to ties 802 such as concrete railroad ties. As shown, one or more elements 800 (in this case two) are positioned near to sides 804 of the ties to promote heating of the ballast 806 between the ties 802. For example, the elements 800 may be within about 2–3 inches of the sides 804. In this manner, ice build up on tie rods or other elements is diminished, further ensuring proper switch operation.

Figure 3:
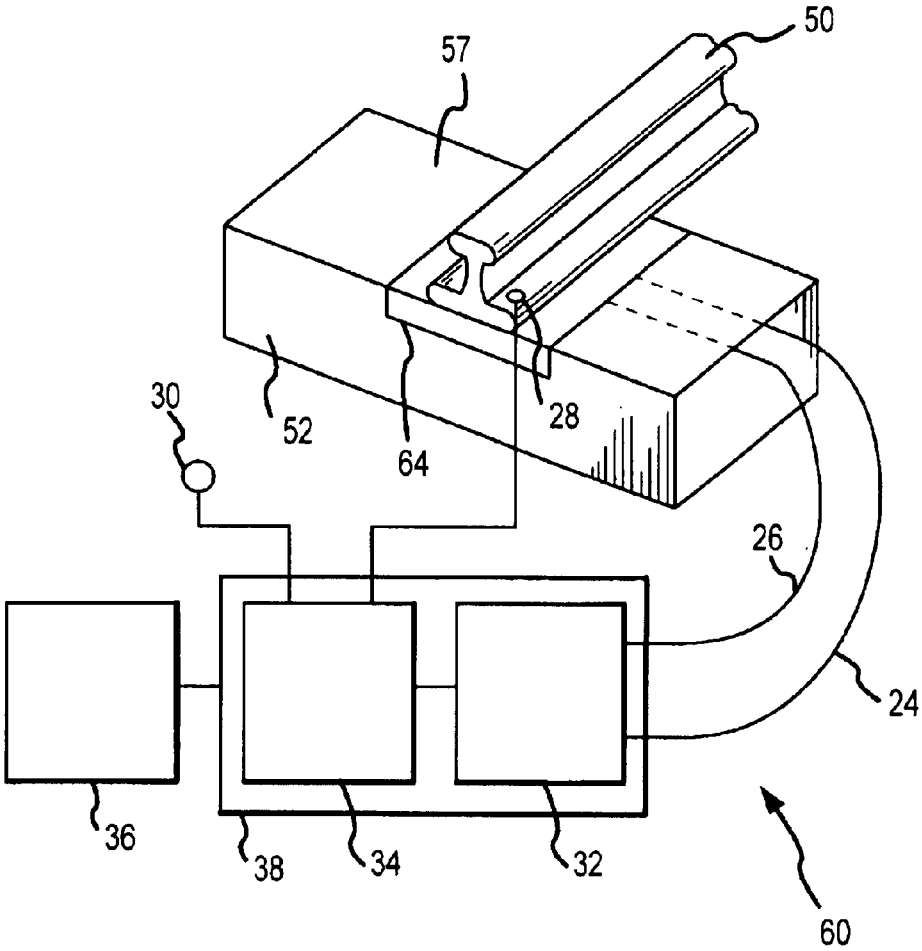
FIG. 3 is a perspective view, partially schematic, of an impedance rail heating system incorporated into a railroad tie in accordance with the present invention.
Figure 4:
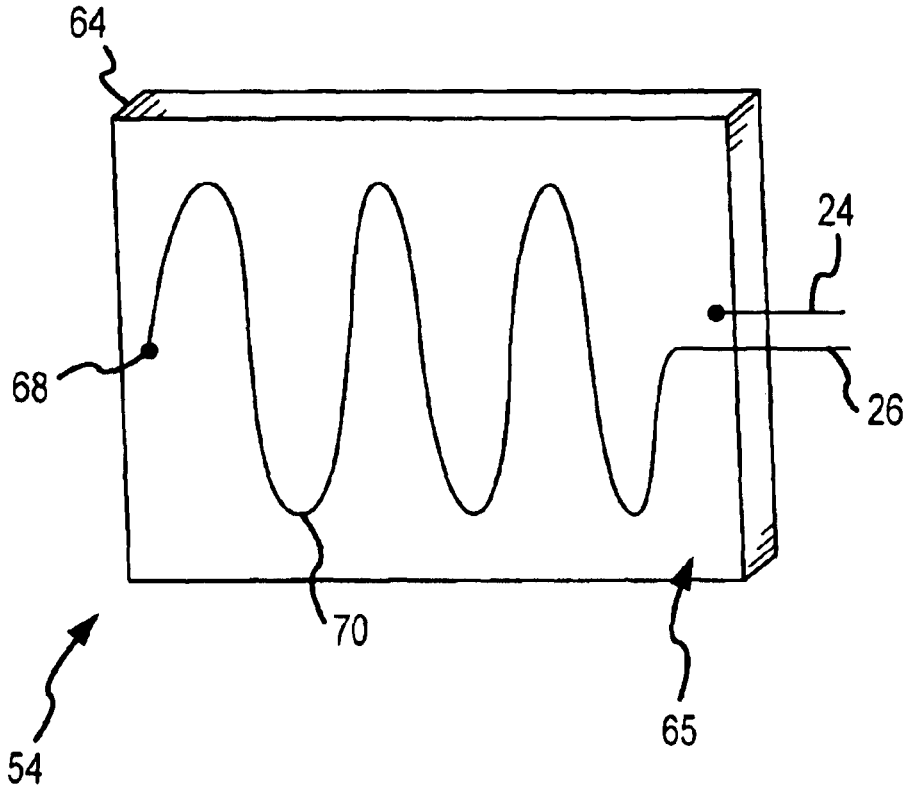
FIG. 4 is a perspective view of an impedance heater element in accordance with the present invention.

Referring to FIGS. 3 and 4 an impedance heating system 60 in accordance with the present invention is illustrated. In particular, FIG. 3 illustrates an impedance heating system 60 utilized with a railroad tie 52. The heating system 60 generally includes a first electrical lead 24, a second electrical lead 26, sensors 28 and 30, a transformer 32 and a processor 34 disposed within a control box 38, an AC power source 36 and at least one electrically conductive element having magnetic properties (e.g., steel plate 64). Each of these elements is described, in turn, below.

The impedance heating system 60 is operative for heating the illustrated railway section 8 by way of inducing a flow of current through the steel plate 64 located on the surface of the railroad tie 52. In accordance with the present invention, the plate 64 is partially embedded within the tie 52 such that the plate 64 is substantially conformal with the tie's top surface 57. FIG. 4 shows the bottom surface 65 of the impedance system's heater assembly 54 which comprises the plate 64 and the electrical leads 24, 26. In a typical impedance heating configuration, a low voltage current (e.g., 80 volts or less) is applied from a transformer 32 associated with a power supply 36 to a first connection point 66 on one end of the plate 64. As shown, the first connection point 66 is interconnected to transformer 34 via electrical lead 24. A second connection point 68 is interconnected to the transformer 32 via electrical lead 26. Upon operation of the heating system, an electrical circuit if formed through the plate 64 between the connection points 66, 68. Electrical lead 26 carries current on the 'out' leg of the circuit path to the far end of the plate 64 (i.e., connection point 68) and the plate 64 carries the current for part of the 'return' leg. Electrical lead 26, in addition to connecting to the second connection point 68, is disposed adjacent to the surface 65 of the plate 64 between the first connection point 66 and the second connection point 68. This adjacent portion of the electrical lead 26 is electrically insulated from the plate surface 65 such that the electric circuit between the connection points 66, 68 does not short.

During operation of the circuit, electrical lead 26 carries alternating current (AC) in the circuit's out leg and the AC flows back through the adjacent plate 64. The adjacent current flow of the out and return legs of the electric circuit cause inductive and magnetic effects to develop with in the plate 64, which causes the AC flow within the plate 64 to concentrate on a band on the plate surface 65 close to the adjacent electrical lead 26. This concentrated return flow band is known as the "skin effect." The skin effect is caused by inductive magnetic fluxes which restricts the AC flows to the surfaces of iron and steel (i.e., ferromagnetic) conductors which are operating in electromagnetic fields. The band of steel on the plate surface 65 adjacent to the lead 26 becomes what may be called a skin effect conductor/resistor. The balance of the plate 64, for practical purposes, is completely insulated electrically from the conductor/resistor. This considerable reduction of what is normally regarded as the effective cross section of an electrical conductor (e.g., the entire plate cross section) greatly increases the effective resistance of what otherwise would be entirely a conductor. Thus, steel structures, which may have a very substantial conductive cross section compared to that of an attached electrical supply lead (e.g., a copper wire conductor) may be practically used as a conductor/resistor.

Impedance heating systems 60 are capable of producing substantial heat within metallic objects as resistance heat develops when current flows within the conductor/resistor. The rapid changes of an alternating current source (e.g., 60 Hz.) induce an electromotive force and a self-inductance that opposes current flow. In addition, magnetic flux coupling between current paths in the impedance heating system also produces heat due to hysteresis (molecular friction) and eddy currents within the metallic object. As will be appreciated, this heat is produced within the steel structure itself where it may conduct to other regions of the structure. In this regard, there is no heat loss from inefficient contact between the structure and, for example, a resistive-type heater element applied to the surface of such a structure.

The greatly increased resistance of the "skin effect" band of the plate 64 in effect turns the plate 64 into a resistive heating element which may be used to heat the railway section 8. An advantage of this system over typical resistive element heaters used with railways, is that the plate 64, unlike typical resistive heater elements is substantially immune from "burn out" and may be made from a durable metal such that it is able to withstand the harsh railroad environment. This provides a heating system with reduced maintenance requirements. The heat generated within the plate's resistive band is conducted throughout the plate 64 and used to heat the rails 50 and the environment surrounding the tie 52, which prevents ice and snow accumulation on the railway section 8. In impedance heating systems, generally no current is carried on the surface opposite the surface where the 'skin' effect is taking place. Accordingly, there is no current loss to the ground or other surroundings nor is there any substantial disruptive electrical signals that may be received by the rail(s) 50.

Impedance heating may utilize commercial AC frequencies of the 50–60 cycles per second range, however, if necessary different frequencies may be used (e.g., 10–1000 Hz or more). Different frequencies may be utilized to prevent interference or allow distinction between the heating frequency and the frequency of signals that are often carried in the rails themselves for communications switching control etc. Additionally, with appropriate circuitry, all three phases of standard AC current generation may be utilized with impedance heating.

As shown in FIG. 4, electrical lead 26 is disposed adjacent to steel plate 64 between first connection point 66 and second connection point 68 in a series of return bends 70. Due to the skin effect, as discussed above, the AC passing between connection points 68 and 66 will follow the path as described by electrical lead 26 rather than taking the shortest route (e.g., a straight line) between the connection points 68, 66. By utilizing the return bend 70 configuration, the length of the conductor/resistor on the plate surface 65 is increased, accordingly, the heat produced within the plate 64 is also increased. The plate surface 65 containing the adjacent lead 26 is embedded within the tie surface 57, such that the leads 24, 26 are disposed between the plate 64 and the tie 52 and are, therefore, protected from the harsh railroad environment. As, noted above, the leads may pass out the tie end 53 or bottom to the transformer 32 such that the leads are removed from the rail area.

Delivery of an electrical signal from the power source to the plate 64 via the leads 24, 26 is controlled by a processor 34 and a transformer 32. The transformer 32 ensures that a low voltage signal is applied to the plate 64. It has been found that a low voltage signal can provide adequate heating while posing a minimal hazard to workmen or others who may come into contact with the rail 50 and or plate 64. Moreover, with inductive heating, the temperature of the heated elements never needs to exceed the desired temperature of the switch to prevent ice build up, e.g., 40–60° F. Nonetheless, access to the switch area may be limited to authorized personnel and appropriate signage may be desired in the vicinity of the heating system 60. In particular, the transformer 32 operates to provide a low voltage, AC current signal to the plate 64. In this regard, an electrical signal of 80 volts or less and preferably 50 volts or less may be applied across the leads 26. The transformer 32 steps down the voltage provided by typical lines of a power grid.

The processor 34 is operative to controllably heat the rail 50. It will be appreciated that heating of the railway section 8 is only necessary when ice build-up is a potential hazard. By controllably operating the system 60 only during such time periods and then only as necessary, the efficiency of the system 60 can be enhanced. In this regard, the processor 34 receives input from sensors 28 and 30. Sensor 30 provides feedback regarding ambient conditions. Although a sensor in contact with a rail is illustrated for this purpose, non-contact snow sensors disposed above the grade of the track or other suitable sensors may be used. For example, the sensor 30 may provide feedback regarding ambient temperature, moisture or humidity, or the like. Thus, for example, the system 60 may only be activated when temperatures are below freezing and moisture is present or humidity exceeds a predetermined threshold. Sensor 28 may provide feedback regarding the temperature of the track rail 50. Such feedback may be used to increase or decrease the power applied to the plate 64 via the leads 26.

Figure 5:
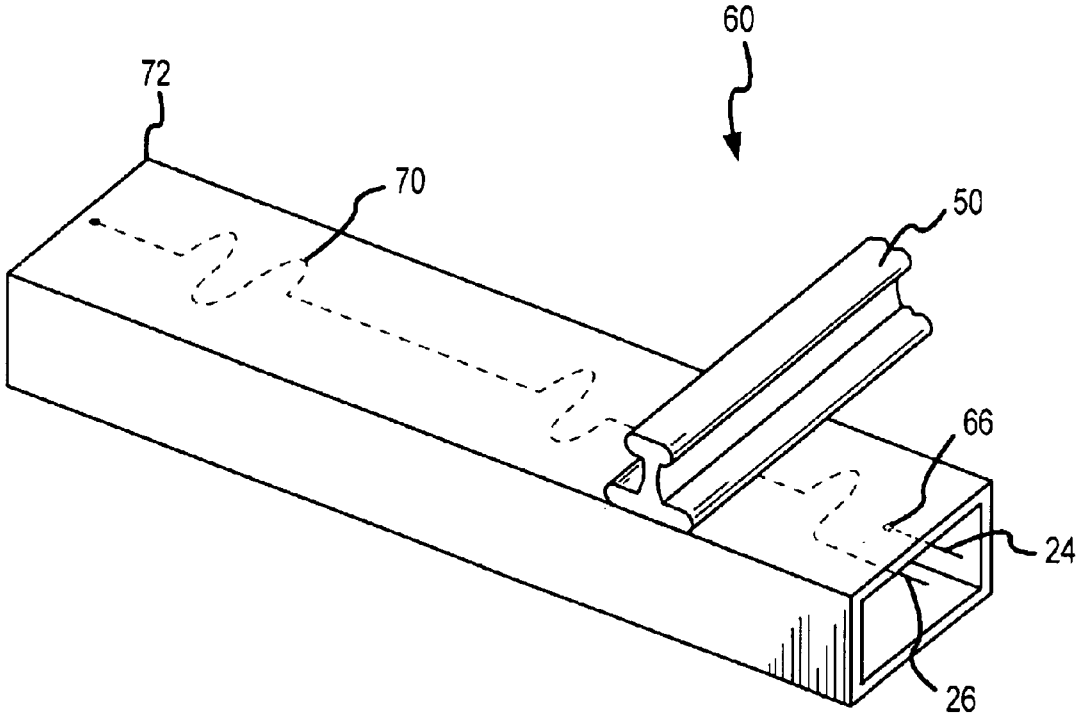
FIG. 5 is a perspective view of a metallic tie utilized as an impedance heating element in accordance with the present invention.

FIG. 5 shows another embodiment of a tie impedance heating system 60. In this embodiment, a hollow metallic tie 72 is used to support the rails 50. Additionally the metallic tie 72 is utilized to provide the conductor/resistor path for the impedance heater; a separate metallic element such as the embedded plate 64 is not required. In this regard, the first lead 24 is connected to one end of the tie's interior top surface. The second lead 26 is connected to the top interior surface on the other end of the metallic tie 72. As discussed above, the second conductive lead 26 must be held in an adjacent relationship to the metallic tie's surface 74 between the first and second connection points 66, 68 to create the "skin effect" for the impedance heating system. In this regard, the second electrical lead 26 may be disposed in an adjacent relationship directly between the first and second connection points 66, 68 or, preferably, as shown by phantom lines in FIG. 5, the adjacent electrical lead 26 utilizes return bends 70 to increase the conductor resistor path and therefore the resistive heat created by the tie-based impedance heating system 60. The return bends 70 are utilized beneath each section where the tie 72 is interfaces with a rail 50 such that more heat may be transferred to these rails 50. However, the entire inside surface 74 may utilize the return bends 70 such that the tie 72 effectively heats the entire region between the rails 50.

In some cases, certain elements of the switching system may be housed within the interior space of such a hollow tie. For example, tie rods may be routed within the hollow tie. While such systems may reduce the amount of structure exposed to the elements, certain critical structure, such as the contact surfaces of the switching rails and structure that emerges from the interior of the tie, may still benefit from heating in accordance with the present invention. Impedance heating of the tie or heater elements placed within the tie so as to avoid mechanical interference with the switching system may be particularly beneficial in this regard.

Figure 6:
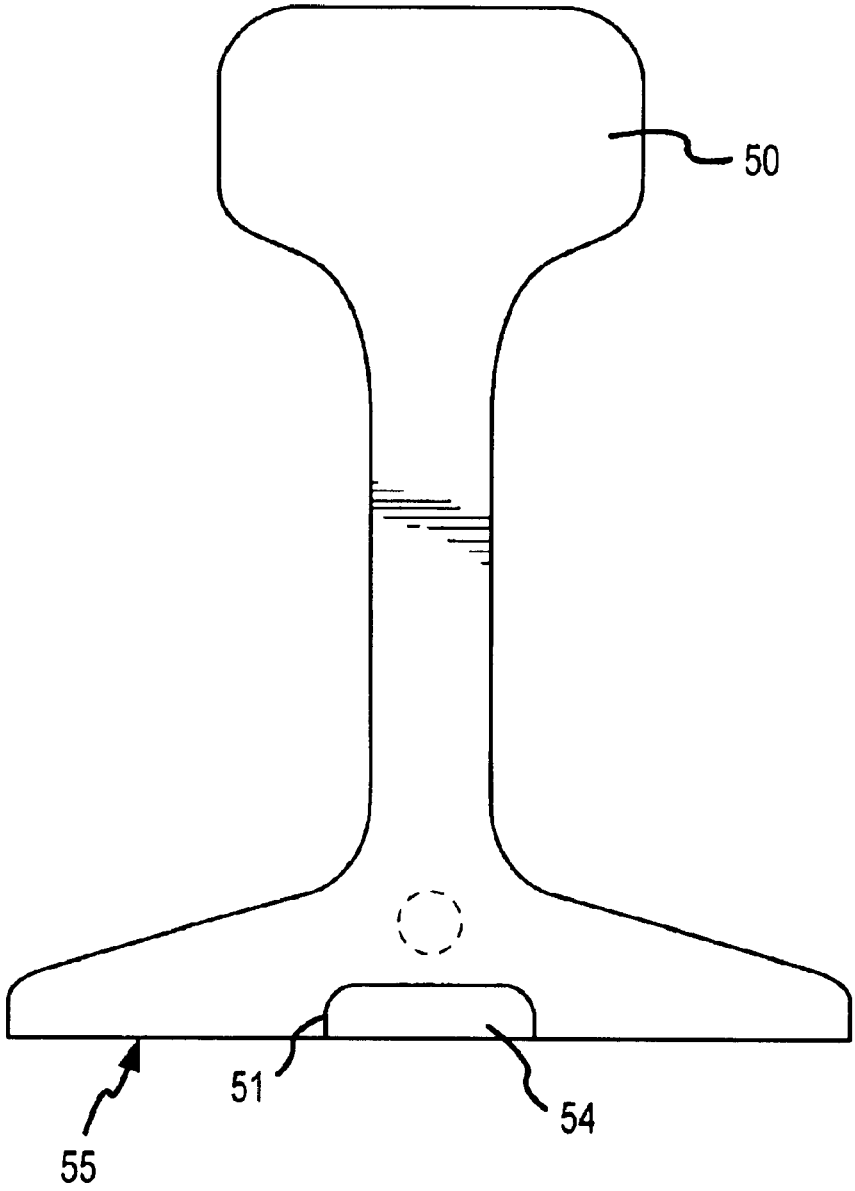
FIG. 6 is a cross sectional view of a track rail with an embedded heater element.

FIG. 6 illustrates another embodiment of the present invention utilizing a heating assembly 54 embedded in a structure associated with the railway section 8 to be heated. Specifically, FIG. 6 shows a heater assembly 54 that is embedded directly within a rail 50 such that substantially no heating elements protrude into the track rail environment. In this regard, the rail 50 generally must be preformed to accommodate the heater assembly 54. For example, the rail 50 may be cast so as to include a recess 51 for partially or wholly receiving an electric heater element 58. The heating element 58 may be substantially as described in U.S. Pat. No. 6,104,010, which is incorporated herein by reference, with appropriate modifications to withstand the casting process. The element 58 may be located internally within the rail 50 or disposed adjacent to a surface of the rail 50. In the illustrated embodiment, the element 58 is embedded in a recess 51 disposed on the bottom 55 of the rail 50 such that when assembled, the heater element 58 is substantially isolated from the rail environment. By locating the heating element 58 as shown, the likelihood of damage to the heater element is minimized.

Figure 7:
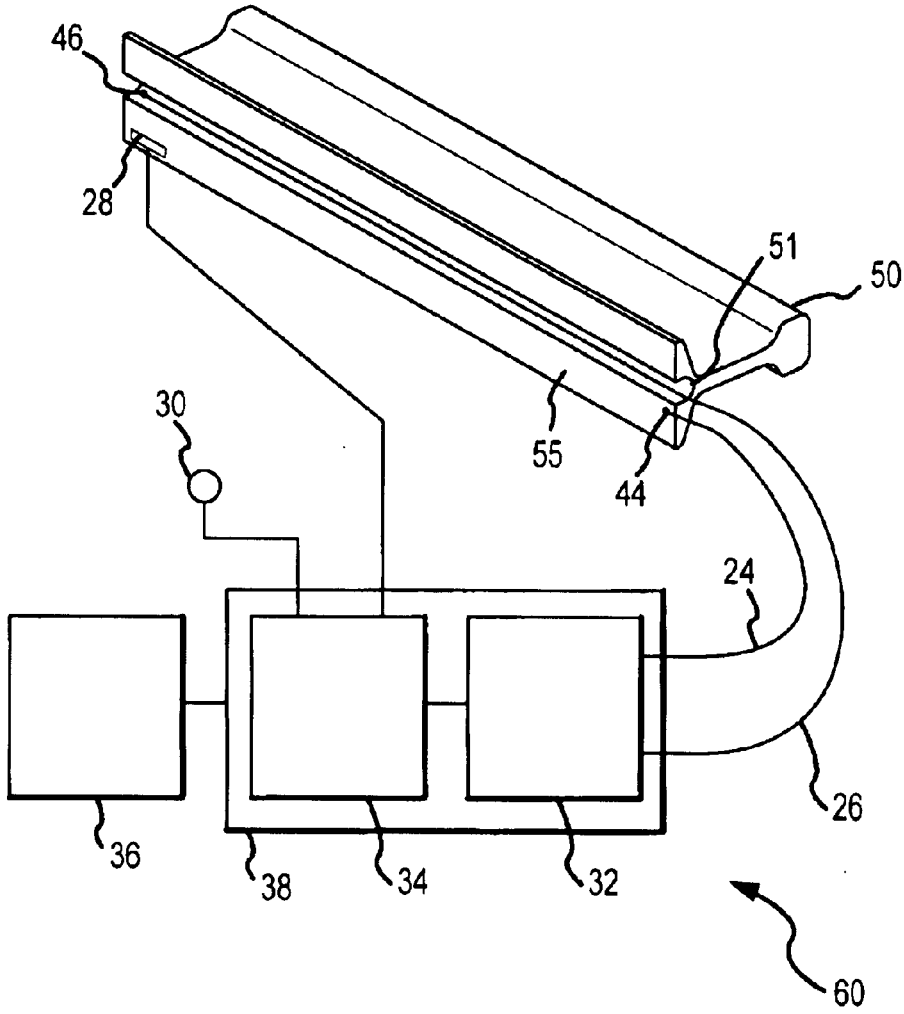
FIG. 7 is a perspective view, partially schematic, of an impedance rail heating system incorporating the track rail as a heating element in accordance with the present invention.

FIG. 7 illustrates another embodiment of the present invention which utilizes part of the railway structure for an impedance heating system 60. In particular, FIG. 8 illustrates an impedance heating system utilizing the track rail 50 to provide an impedance conductor/resistor for use in heating a railway section 8. The impedance heating system 60 again generally includes a first electrical lead 24, a second electrical lead 26, sensors 28 and 30, and a transformer 32 and processor 34 disposed within a control box 38. The first electric lead 24 is interconnected to a first point 44 on the rail 50 and the second electrical lead 26 is interconnected to the second point 46 on the rail 50. Additionally the second lead 26 is disposed in an adjacent relationship with the bottom surface 55 of the rail 50 between the first and second connection points 44, 46 to provide the inductance for the "skin effect." Alternatively, the second lead could be disposed adjacent a side of the rail, e.g., mounted on a tie. As shown, the second electrical lead 26 is embedded in a recess 51 located on the rail's bottom surface 55 to substantially isolate the lead 26 from the switch environment. As will be appreciated, this embodiment enables a resistive heat caused by the skin effect to be created directly within the rail 50 itself, allowing the rail 50 to effectively become its own heater element. It will be appreciated that the illustrated system 60 has inherent efficiency advantages because the rail 50 is directly heated and there is substantially no loss due to any heat transfer interface between an external heater element and the rail 50. Moreover, due to the electrical lead 26 being disposed on the bottom surface 55 of rail the 50, there are substantially no protruding heating elements which are susceptible to damage. Further, as the rail 50 is utilized as the heater element, there is little or no chance of heater element burn out, thus providing a system with low maintenance requirements.

Though described with particularity for a railroad tie 52 and the rail 50 itself in connection with conventional track switches, an impedance heating system or any other embodiment described above may be effectively utilized with any railway switching structure involving moving rails and/or other elements. In particular, so called "spring frogs", "movable point frogs" and other movable rail devices may utilize the heating systems of the present invention to keep sensitive train wheel transfer areas clear of snow and ice.

One issue that may need to be addressed in certain track environments relates to isolating the electrical energy applied to the track for purposes of heating from the electrical signals used for signaling. In this regard, electricity may be transmitted through the tracks for use in controlling track signals. As noted above, the various railroad structure heater embodiments utilize electricity passing through various railway structures to produce heat. This heating electricity may alter or interfere with the electric signals used for signaling. This is especially true in the embodiments that utilize the rail itself for heating purposes. Generally, the embodiments where the heater assembly is located in a railroad tie can be electrically isolated from the rails to prevent electrically connecting the rails or grounding the signals carried by the rails. However, the heated tie embodiments may affect the signaling signals through the generation of electromagnetic fields.

The possibility of interfering with signals may be addressed in a variety of ways. For example, the electrical energy used for heating the track portion may be a low voltage, high current signal such that the heating energy and signaling signals may be of sufficiently different frequencies so as to not unduly interfere with one another. As noted above, the impedance heaters may be utilized across a wide frequency range allowing great flexibility in applying heating energy in frequencies different from the signaling signal frequencies such that the two are easily distinguishable. Alternatively, electrical filters may be employed to isolate the heating energy and signaling signals from one another based on frequency or other signal characteristics. A system may be configured to turn off the heating system when a signaling signal is detected or when a train is detected in proximity to the switch. In this regard, an approaching train utilizing the rails for signaling would cause the heating system to deactivate until the train had passed when the heating system would resume operation, thereby preventing the heating energy from affecting the train's signaling signals. For example, train proximity may be sensed by appropriately placed optical sensors, pressure sensors, eddy current sensors, motion detectors, GPS or other location signals or any other suitable mechanism. As will be appreciated, a deactivation system is more likely to be used in areas having sufficiently low train volume such that the heating system operates often enough to keep the tracks clear of snow and ice.

Another solution is to isolate the heated section of track and by-pass the signaling signals around the heated section. In this regard insulation barriers may be provided at each end of the section of track to be heated in order to electrically isolate the heating system from the remainder of the track. In certain cases electrical contacts may be provided at each end of the heated track section, but isolated from the heated section, such that the train wheels can establish and electrical connection to transmit the signaling signals. A parallel by-pass path (e.g., a conducting cable) may be then be provided connecting the rails around the heated section of track in order to provide continuity of transmission of signaling signals across the track section. By-passing the heated section may also be done by utilizing alternative signaling means that do not utilize the rail tracks. Examples of such systems include, in the case of the switching signals, optical detection systems that are able to detect the presence of an approaching train using, for example, infrared signals from the train wherein upon receiving these signals the optical detection system transmits these signals to the switch controller. The switch control signals may be transmitted from the detector over any transmission medium that does not require use of the rail, including but not limited to, radio frequency transmissions and the use of data communication networks.

What is claimed is:

1. A heating system for heating a movable structure section of a railroad track, said system comprising:

a power source for providing electrical power;

at least a first heater assembly associated with a railroad tie for placement beneath and interconnection with a track rail, wherein said heater assembly is substantially contained within a spatial envelope of said railroad tie;

an electrical interface for applying an electric potential across said heater assembly sufficient to induce a current in said heater assembly; and control means for coupling said electrical interface to said power source such that said heater assembly controllably heats said section of railroad track.

2. The system of claim 1, wherein said heater assembly is embedded in said railroad tie.

3. The system of claim 2, wherein said heater assembly is embedded within said railroad tie such that upon placement beneath said track rail, said heater assembly is disposed between said railroad tie and said track rail.

4. The system of claim 3, wherein said heater assembly is embedded within said railroad tie such that a top surface of said heater assembly is substantially flush with a surface of said railroad tie.

5. The system of claim 4, wherein said heater assembly is one of a resistive element type heater and an impedance type heater.

6. The system of claim 1, wherein said railroad tie is a metallic tie.

7. The system of claim 6, wherein said metallic tie is utilized as the heating element for an impedance type heater assembly.

8. The apparatus of claim 6, wherein said metallic tie is hollow.

9. The apparatus of claim 8, wherein a plurality of heater assemblies are disposed within said hollow metallic tie.

10. The apparatus of claim 1, wherein said section of railroad track rail is electrically isolated from connecting portions of track rails, such that said heater assembly does not affect communication signals within said track rails.

11. The apparatus of claim 10, wherein said connecting portions of track rails are interconnected via a parallel path such that any interference from said heater assembly is by-passed.

12. The apparatus of claim 1, wherein said system is operative for heating said movable structure section including an area between adjacent railroad ties.

13. An impedance heating system that utilizes a metallic tie for heating a section of railroad track, wherein said tie is placed beneath and interconnected with said section of railroad track:

a power source for providing electrical power;

a first electrical conductor, interconnected to a first point on said metallic tie;

a second electrical conductor, interconnected to a second point on said metallic tie, wherein a portion of said second electrical conductor is disposed in an adjacent electrically insulated relationship with a surface of said metallic tie between said first and second connection points; and control means for coupling said electrical conductors to said power source such that an electrical circuit is formed through said metallic tie for controllably heating said section of railroad track.

14. The impedance heater of claim 13, wherein said metallic tie is hollow and said conductors interconnect to said tie on an inside surface such that no elements protrude above the outside surface of said tie.

15. An impedance heating system that utilizes the track rail for heating a section of railroad track, said system comprising:

a power source for providing electrical power;

a first electrical lead, interconnected to a first point on said track rail;

a second electrical lead, interconnected to a second point on said track rail, wherein a portion of said second electrical lead is disposed in an adjacent electrically insulated relationship with a surface of said track rail between said first and second points; and control means for coupling said electrical leads to said power source such that an electrical current flows through said track rail between said first and second points for controllably heating said section of railroad track.

16. The impedance heater of claim 15, wherein said portion of said second electrical lead in said adjacent relationship is disposed relative to a bottom surface of said track rail between said first and second points.

17. The impedance heater of claim 15, wherein said portion of said second electrical lead in said adjacent relationship is embedded within a recess on said track rail.

18. The system of claim 17, wherein said recess is located on one of a web surface of said track rail and a bottom surface of said track rail.

19. A heating system for heating a movable structure section of a railroad track, said system comprising:

a power source for providing electrical power;

at least a first heater assembly associated with a railroad structure, wherein said heater assembly has a heater structure that is substantially contained within a spatial envelope of said railroad structure such that said railroad structure is substantially free from protrusions therefrom associated with said heater structure;

an electrical interface for applying an electric potential across said heater assembly sufficient to induce a current in said heater assembly;

a control means for coupling said electrical interface to said power source such that said heater assembly controllably heats said section of railroad track, wherein said section of railroad track rail is electrically isolated from connecting portions of track rails; and a parallel path interconnecting said connecting portions of track rails for carrying communication signals within said track rails such that any interference from said heater assembly is by-passed.

* * * * *